US011389692B2

(12) United States Patent
Stearns et al.

(10) Patent No.: US 11,389,692 B2
(45) Date of Patent: Jul. 19, 2022

(54) CLIMBING EXERCISE APPARATUS

(71) Applicants: Kenneth W Stearns, Houston, TX (US); Joseph D Maresh, West Linn, OR (US)

(72) Inventors: Kenneth W Stearns, Houston, TX (US); Joseph D Maresh, West Linn, OR (US)

( * ) Notice: Subject to any disclaimer, the term of this patent is extended or adjusted under 35 U.S.C. 154(b) by 0 days.

(21) Appl. No.: 16/687,478

(22) Filed: Nov. 18, 2019

(65) Prior Publication Data

US 2020/0254303 A1 Aug. 13, 2020

Related U.S. Application Data

(60) Provisional application No. 62/917,028, filed on Nov. 16, 2018, provisional application No. 62/919,562, filed on Mar. 18, 2019.

(51) Int. Cl.

| | |
|---|---|
| ***A63B 22/04*** | (2006.01) |
| ***A63B 21/00*** | (2006.01) |
| ***A63B 22/00*** | (2006.01) |

(52) U.S. Cl.

CPC ..... *A63B 22/04* (2013.01); *A63B 21/154* (2013.01); *A63B 21/4034* (2015.10); *A63B 21/4035* (2015.10); *A63B 21/4045* (2015.10); *A63B 22/0046* (2013.01); *A63B 2022/0092* (2013.01)

(58) Field of Classification Search

CPC . A63B 21/00185; A63B 21/068; A63B 21/15; A63B 21/159; A63B 21/4027; A63B 21/4033; A63B 21/4034; A63B 21/4035; A63B 21/4045; A63B 22/0046; A63B 22/04; A63B 22/20; A63B 22/201; A63B 22/205; A63B 2022/0092; A63B 23/035; A63B 23/03516; A63B 23/03533; A63B 23/03541; A63B 23/03575; A63B 23/03583; A63B 23/03591; A63B 25/00; A63B 2208/0204; A63B 2208/0285; A63B 2208/029; A63B 2225/09; A63B 2225/093

See application file for complete search history.

(56) References Cited

U.S. PATENT DOCUMENTS 3,381,958 A * 5/1968 Gulland ..... A63B 22/001 482/96
4,023,436 A * 5/1977 Dodge ..... B62K 21/16 74/551.3

(Continued)

FOREIGN PATENT DOCUMENTS

CA 3030702 A1 * 12/2017 ..... A63B 23/03583

*Primary Examiner* — Gary D Urbiel Goldner
(74) *Attorney, Agent, or Firm* — Nick A Nichols, Jr.

(57) ABSTRACT

A climbing exercise apparatus having homolateral and contralateral modes of operation may include a frame supporting generally vertically oriented movable slide members in spaced apart relationship to one another. The slide members may include foot supports secured at lower distal ends thereof and handlebars in adjustable telescopic relationship with the slide members. Handgrips may be rotatably mounted proximate to upper distal ends of the handlebars. The handgrips may be rotatably about a canted axis which is canted relative to a longitudinal axis of the handlebars and selectively locked for the homolateral and contralateral modes operation of the climbing exercise apparatus.

8 Claims, 12 Drawing Sheets

(56) References Cited

U.S. PATENT DOCUMENTS 4,249,762 A * 2/1981 Richards ..... A63B 15/00 473/256
4,958,830 A * 9/1990 Huggins ..... A61H 1/0259 482/51
4,982,952 A * 1/1991 Wang ..... A63B 22/001 482/53
5,007,631 A * 4/1991 Wang ..... A63B 22/001 482/119
5,037,088 A * 8/1991 Bernstein ..... A63B 23/0355 482/112
5,040,785 A * 8/1991 Charnitski ..... A63B 23/0417 482/51
5,167,596 A * 12/1992 Ferber ..... A63B 21/0004 482/114
5,169,361 A * 12/1992 Hsu ..... A63B 21/0083 482/111
5,199,932 A * 4/1993 Liao ..... A63B 22/001 482/113
5,222,927 A * 6/1993 Chang ..... A63B 21/0552 482/126
5,295,927 A * 3/1994 Easley ..... A63B 21/015 482/51
5,490,818 A * 2/1996 Haber ..... A63B 22/001 482/112
5,492,515 A * 2/1996 Charnitski ..... A63B 22/001 482/37
D369,390 S * 4/1996 Haber ..... D21/670
5,755,646 A * 5/1998 Chu ..... A63B 21/4001 482/115
5,803,880 A * 9/1998 Allen ..... A63B 21/0087 482/113
9,358,421 B2 * 6/2016 Mercenari Uribe ... A63B 22/04
D802,688 S * 11/2017 Sun ..... D21/670
D838,789 S * 1/2019 Hu ..... D21/670
10,179,260 B1 * 1/2019 Stearns ..... A63B 21/4045
10,773,144 B2 * 9/2020 Frost ..... A63B 69/0057
10,987,539 B1 * 4/2021 Stearns ..... A63B 22/04
2013/0210587 A1 * 8/2013 Shank ..... A63B 25/08 482/77
2015/0343259 A1 * 12/2015 Mercenari Uribe . A63B 22/205 482/52
2019/0160331 A1 * 5/2019 Mercenari Uribe . A63B 21/008

* cited by examiner

CLIMBING EXERCISE APPARATUS

CROSS-REFERENCE TO RELATED APPLICATION

This application claims priority to and the benefit of the filing dates of U.S. Provisional Application Ser. No. 62/917,028, filed Nov. 16, 2018, and U.S. Provisional Application Ser. No. 62/919,562, filed Mar. 18, 2019, which applications are herein incorporated by reference in their entirety.

BACKGROUND

The present invention relates to fitness equipment, more particularly to climbing exercise apparatus where the exercise paths are substantially vertical and parallel to each other.

Climbing exercise machines permit a user to simulate climbing activities where two coordinated body movements are generally possible. A first motion may be referred to as homolateral movement where an asymmetrical movement of the upper limb and the lower limb on the same side occurs, and a second motion referred to as contralateral movement where diagonal movement of an upper limb with the opposite lower limb occurs. The first motion of homolateral movement or straight climbing is more closely correlated with martial arts where martial arts typically employ homolateral movements, whereas the second motion of asymmetrical or cross climbing action is more closely correlated with oppositional exercises such as swimming and walking. In homolateral motion the body halves do not cooperate but move separately, and in contralateral motion both sides of the brain function at the same time in a coordinated manner.

SUMMARY

A climbing exercise apparatus having homolateral and contralateral modes of operation may include a frame supporting movable generally vertically oriented members in spaced apart relationship to one another. The vertically oriented members may include foot supports secured at the lower distal ends thereof and handlebars in adjustable telescopic relationship with the vertically oriented members. Handgrips may be rotatably mounted proximate the upper distal ends of the handlebars. The handgrips may be rotatable about canted axes which are canted relative to the longitudinal axis of the handlebars. The handgrips may be selectively locked for homolateral and contralateral operation of the climbing exercise apparatus.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
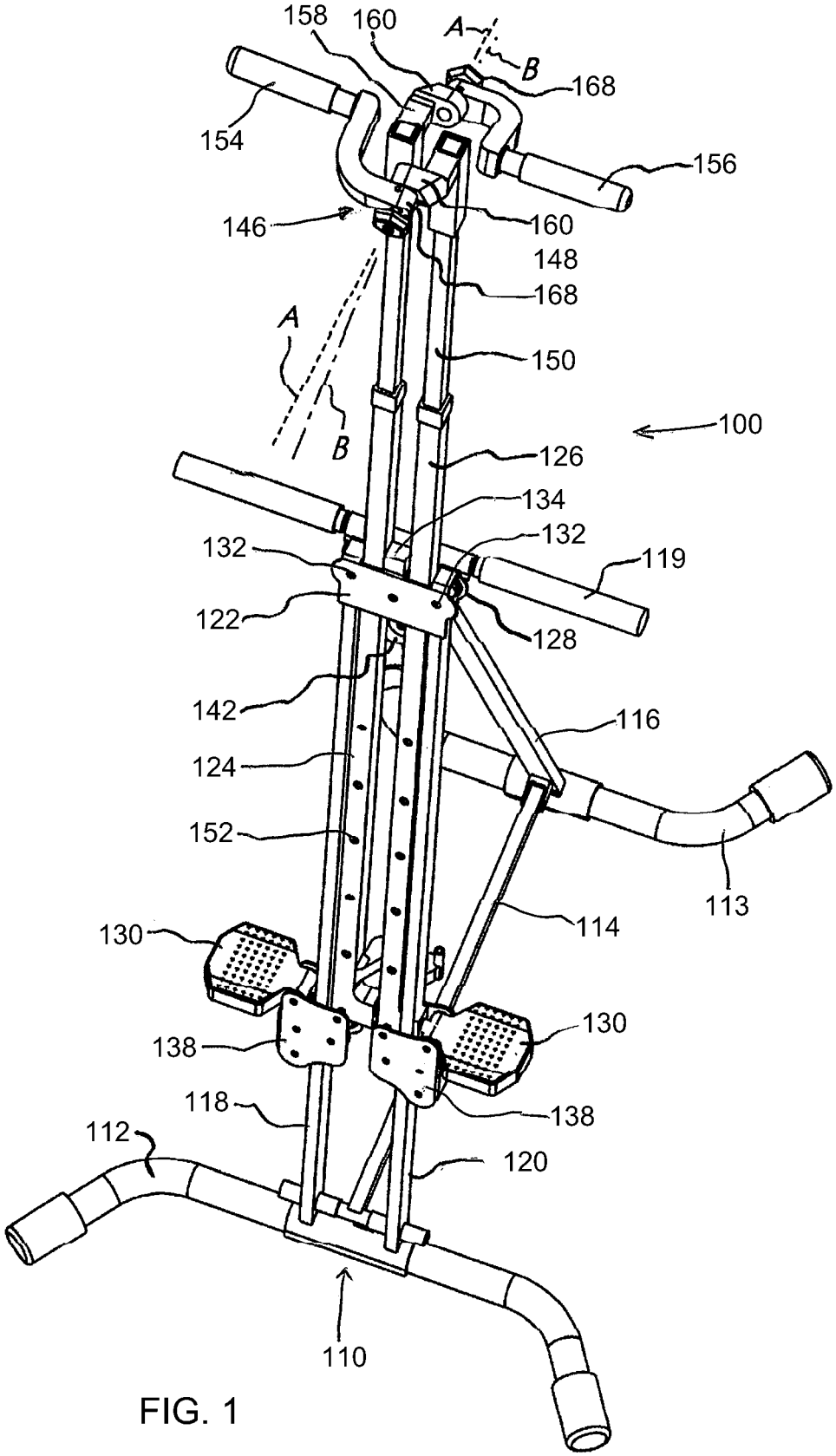
FIG. 1 is a perspective view of a climbing exercise apparatus.

Referring first to FIG. 1, a climbing exercise apparatus is generally identified by the reference numeral 100. The climbing exercise apparatus 100 may include a frame 110 comprising spaced apart base members 112, 113 interconnected by a cross connecting member 114. A generally vertically extending left guide member 118 and a right guide member 120 may be fixedly secured to the base member 112. The left and right guide members 118, 120 may be spaced apart and connected proximate the upper distal ends thereof by a transverse bracket 122 bridging the space between the left and right guide members 118, 120 and maintaining the parallel relationship between one another. A generally angularly extending brace member 116 may have a lower end secured to the base member 112 and an upper end connected to the bracket 122. The left and right guide members 118, 120 may extend generally vertically upward from the base member 112 angled generally toward the base member 113 at an acute angle $\alpha$ of about fifteen (15°) degrees.

The left and right guide members 118, 120 may movably support left and right tubular slide members 124,126, respectively. The guide members 118, 120 and slide members 124, 126 are depicted in the drawings as having a substantially rectangular cross section. It will be appreciated, however, that the guide members 118, 120 and slide members 124, 126 may include other cross-sectional shapes, such as, but not by way of limitation, circular, cylindrical, triangular and the like cross-sectional shapes. The slide members 124, 126 may be linearly reciprocated relative to the guide members 118, 120. Rollers 128 and the like may provide a linear bearing surface in a manner known in the art. Foot platforms 130 may be secured proximate the lower distal ends of the reciprocating members 124, 126, generally in a non-adjustable manner. A cover or shroud may be secured to the frame 110 to cover or enclose the central portion of the climbing exercise apparatus 100.

The rollers 128 may be disposed between front and rear plates of the bracket 122. The rollers 128 may be rotatable about shafts 132 fixedly securing the bracket 122 to the left and rights guide members 118, 120. The bracket 122 may include a center block 134 secured between the front and rear plates thereof. The center block 134, in cooperation with the rollers 128, may provide lateral constraint to the reciprocal movement of the slide members 124, 126.

Foot platforms 130 may be fixedly secured proximate the lower ends of the slide members 124, 126 in a generally non-adjustable manner. In some instances, the foot platforms 130 may be configured for pivoting movement. The foot platforms 130 may be secured to generally C-shaped foot brackets 138 fixedly secured proximate the lower ends of the slide members 124, 126. Rollers 140 may be rotatably secured to the foot brackets 138 providing lateral constraint at the lower ends of the slide members 124, 126.

The slide members 124, 126 are generally vertically oriented and may be linearly reciprocated by a user a distance which corresponds to the maximum desired stepping height of the user. A pulley 142 may be rotatably secured to the bracket 122. A flexible member or cable 144 may be utilized to provide reciprocal or oppositional dependent action of the slide members 124, 126. The cable 144 may be routed over the pulley 142 and the distal ends thereof secured to respective slide members 124, 126.

Left and right handlebars 146, 148 may be adjustably secured to the slide members 124, 126. The handlebars 146, 148 may include elongated handlebar leg members 150 in telescopic relationship with a respective slide member 124, 126. The handlebars 146, 148 may be selectively adjusted relative to the slide members 124, 126. The handlebars 146, 148 may releasably engage with detent adjustment holes 152 formed in the slide members 124, 126 to set the handlebars 146, 148 to the expected arm reach of a user of the climbing exercise apparatus 100.

The left and right handlebars 146, 148 may include left and right handgrips 154, 156 secured to the upper distal ends of the handlebar leg members 150. The left and rights handgrips 154, 156 may be rotatably secured to mounting stubs 158 projecting from the handlebar leg members 150. The mounting stubs 158 may extend outwardly from the handlebar leg members 150 defining an axis A perpendicular to the longitudinal axis of the handlebar leg members 150. The mounting stubs 158 may include a stub boss 160 at the distal ends thereof having an outwardly facing generally flat or planar face 162 which is slanted rearward from the top edge to the bottom edge of the planar face 162. The stub boss 160 may include a threaded borehole 164 defining an axis B perpendicular to the face 162 of the stub boss 160. The axes A and B may define a canted angle θ between five to thirty degrees (5° to 30°). The handgrips 154, 156 may be coupled to the handlebar leg members 150 by threading the threaded shaft 166 of a knob 168 through a hole 155 extending through the handgrips 154, 156 proximate the distal ends thereof into the borehole 164 of the stub boss 160 so that the handgrips 154, 156 are rotatable about the canted axis B.

Figure 4:
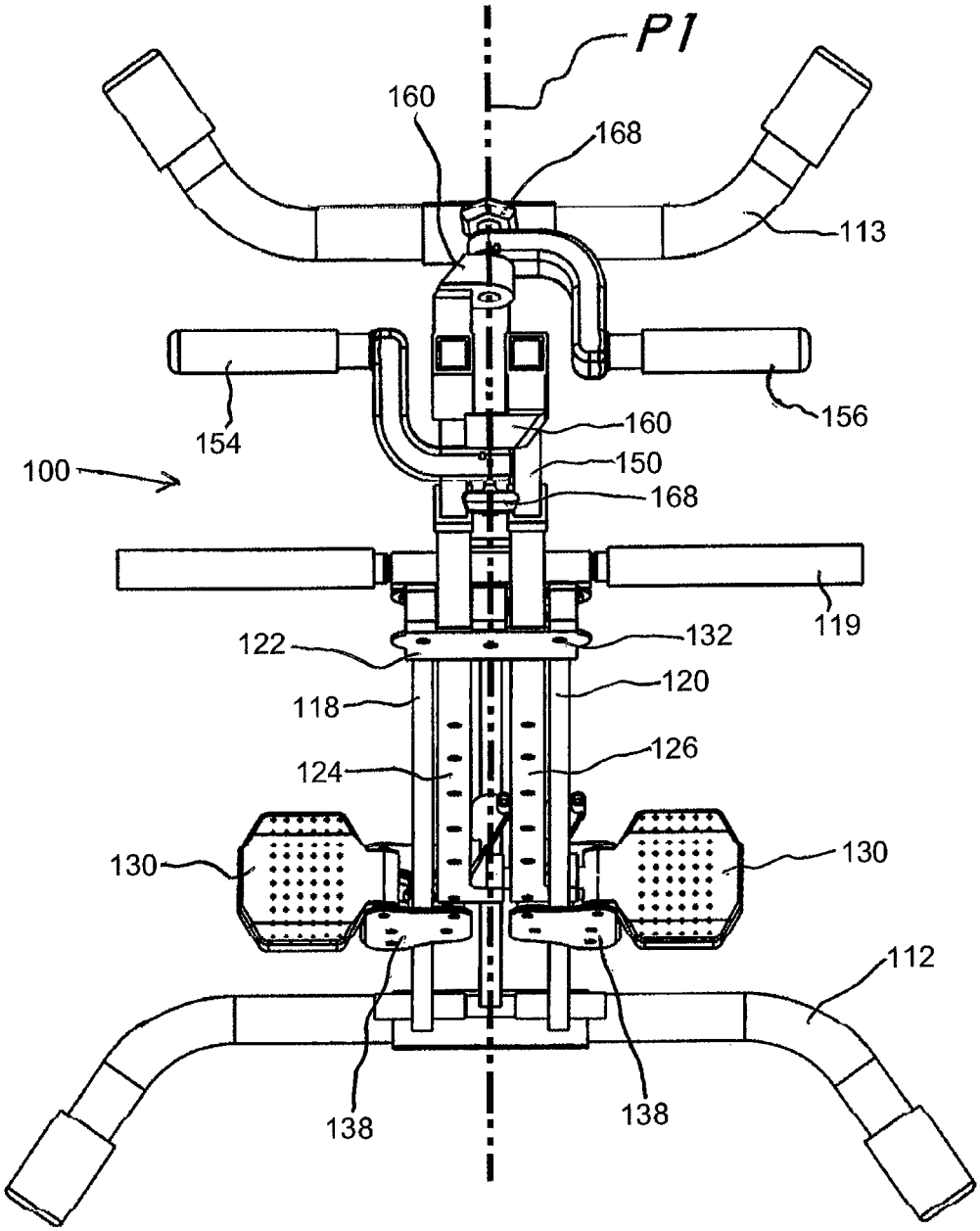
FIG. 4 is a top view of the climbing exercise apparatus shown in FIG. 1.

Referring now to FIG. 4, it will be recognized that the axes B lie in a vertical plane P1 at the transverse center of the climbing exercise apparatus 100, illustrating that the lateral displacement of the handgrips 154, 156 is equal in both the homolateral and contralateral modes of operation of the climbing exercise apparatus 100.

Figure 2:
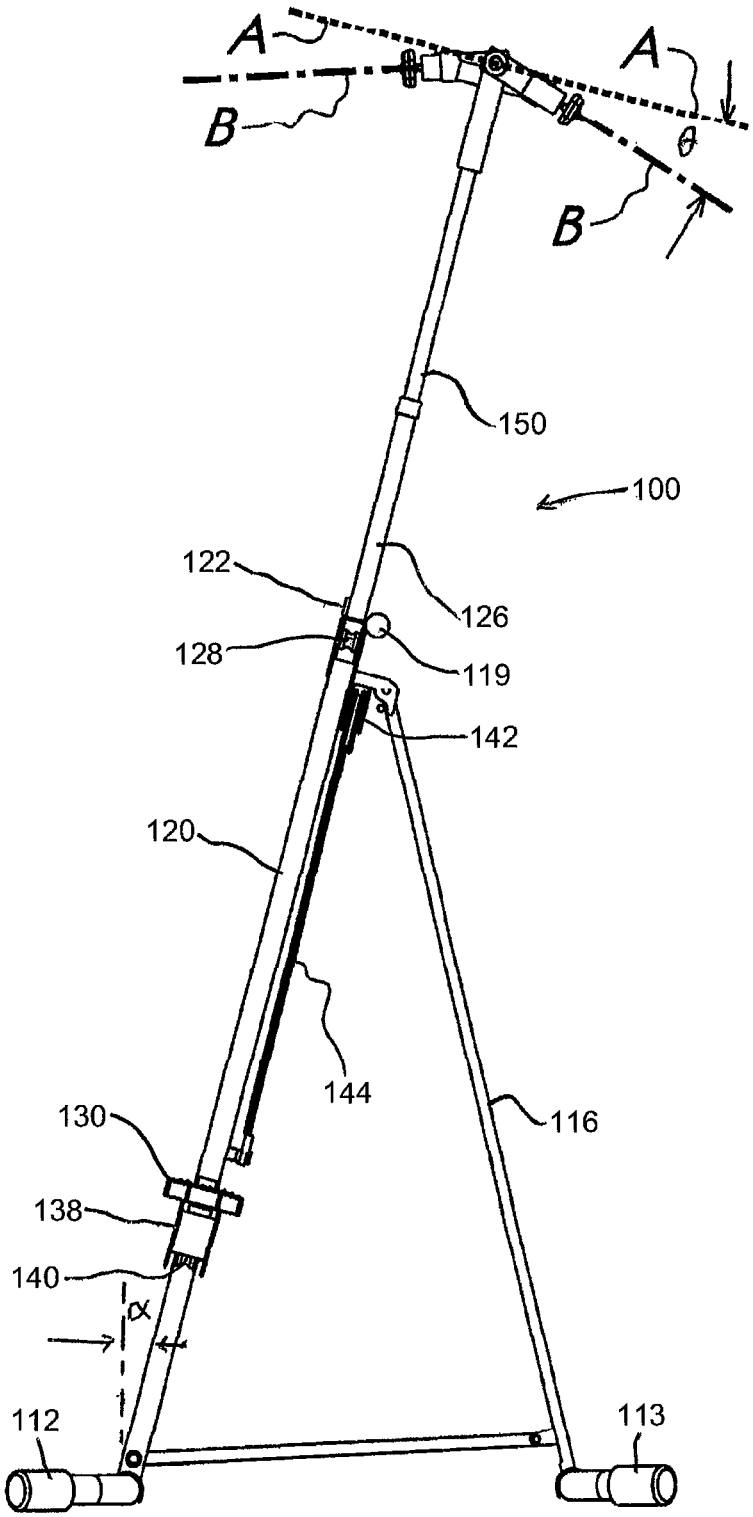
FIG. 2 is a side view of the climbing exercise apparatus shown in FIG. 1.
Figure 3A:
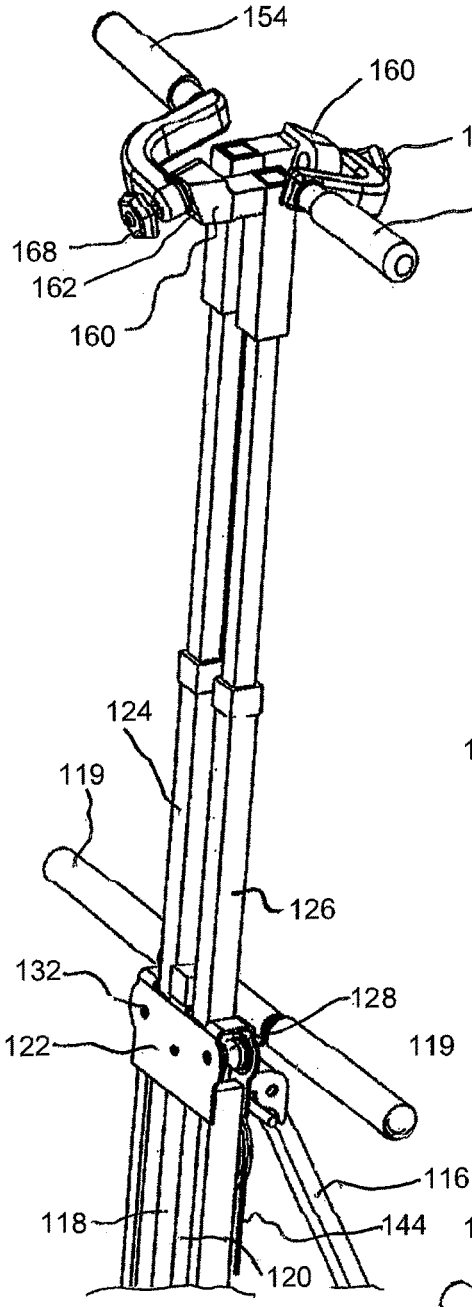
FIGS. 3A-3C are partial perspective views depicting the transition from the contralateral exercise mode to the homolateral exercise mode of the climbing exercise apparatus shown in FIG. 1.
Figure 3B:
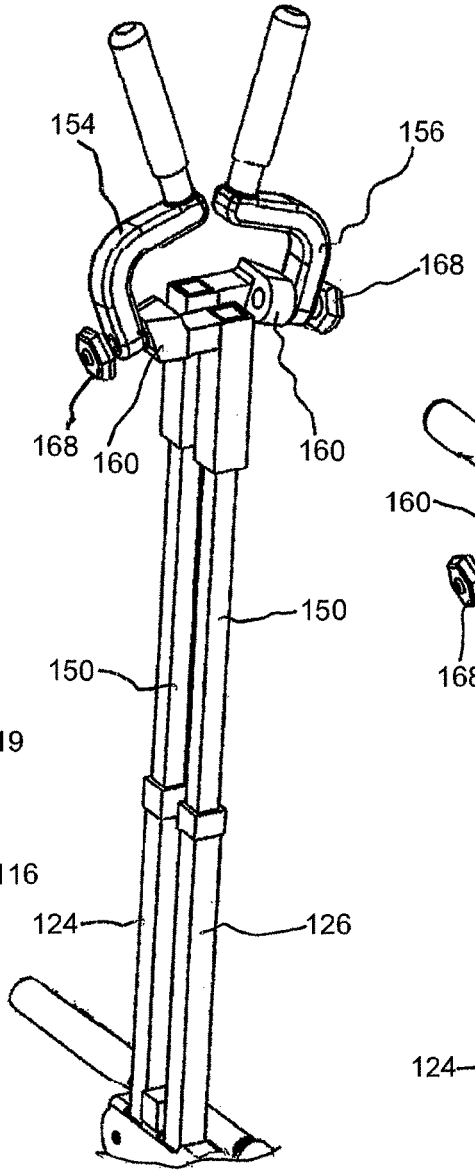
Figure 3C:
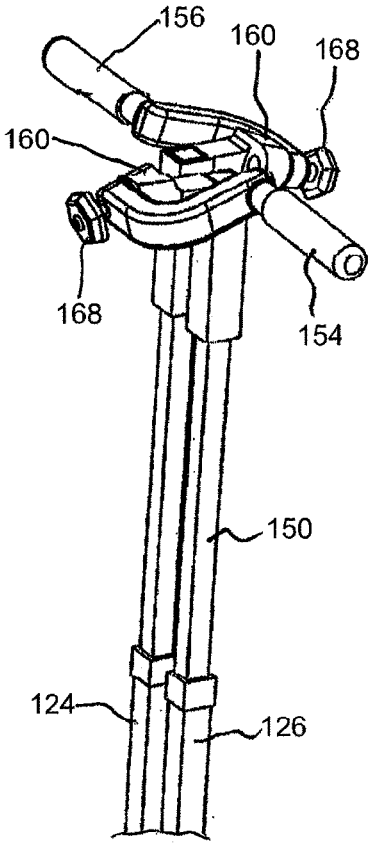

The handgrips 154, 156 may be secured to the handlebar leg members 150 for a user to operate the climbing exercise apparatus 100 in both a homolateral (straight) or a contralateral (cross) exercise mode. Changing the mode of operation of the climbing exercise apparatus 100 from a homolateral mode to a contralateral mode or vice versa may be performed by loosing the knob 168 and rotating the handgrips 154, 156 about the axis B to the opposite lateral side of the climbing exercise apparatus 100. The canted axes B permit rotation of the handgrips 154, 156 about the axes B without colliding, as depicted in FIGS. 3A-3C, which show the transition of the handgrips 154, 156 from the contralateral mode to the homolateral mode of operation of the climbing exercise apparatus 100. The canted angle θ, for example, but not by way of limitation, illustrated in FIGS. 1 and 2 may be approximately eighteen (18°) degrees.

Figure 5:
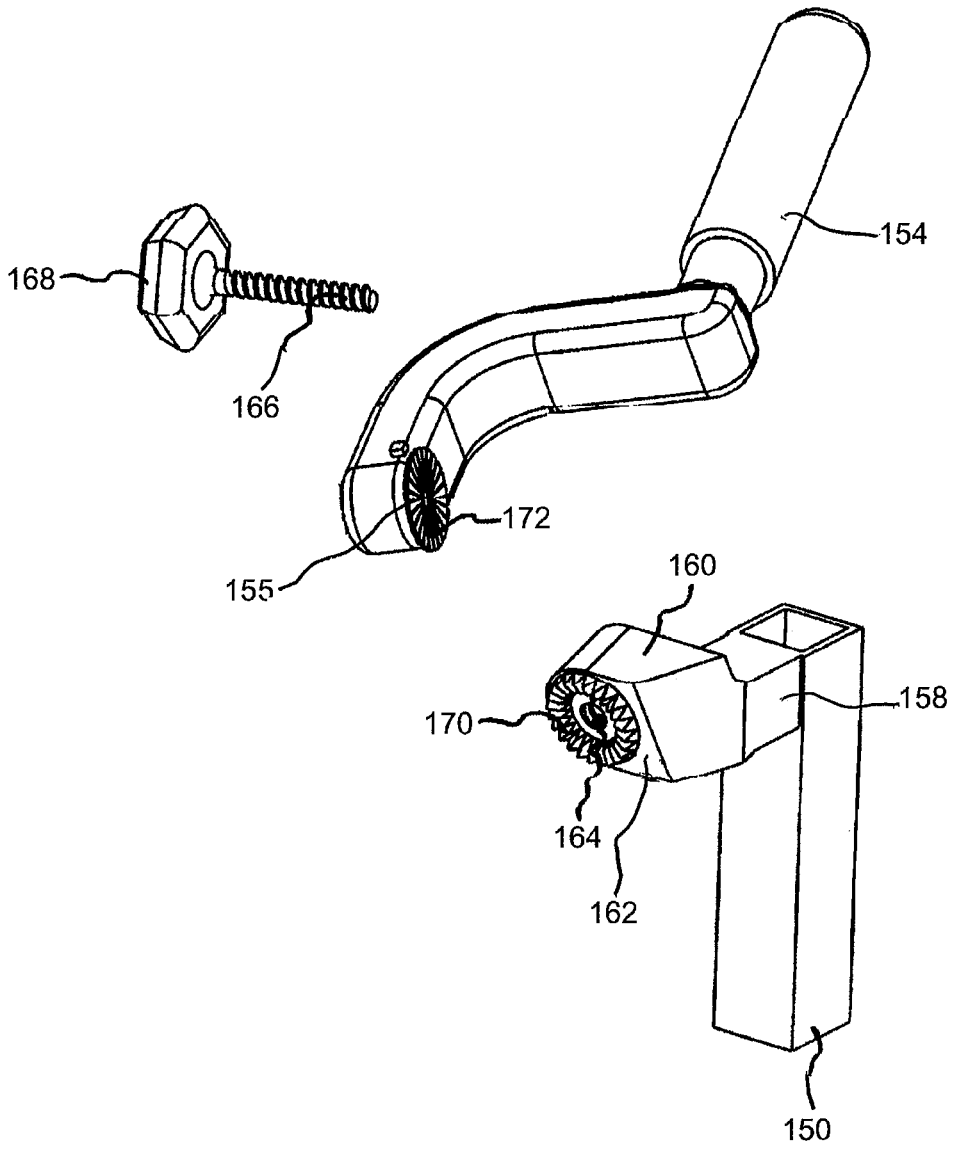
FIG. 5 is an exploded partial perspective view of a handlebar of the climbing exercise apparatus shown in FIG. 1.

Referring now to FIG. 5, the planar face 162 of the stub boss 160 and the interface surface of the handgrips 154, 156 may include a crown or circumferentially displaced tips and divots 170, 172, respectively, to minimize the torque required to tighten or loosen the knob 168. The tips and divots 170, 172 may permit angular micro adjustments to enable the user to set the handgrips 154, 156 at angles relative to the axis B other than horizontal, as desired.

Figure 6:
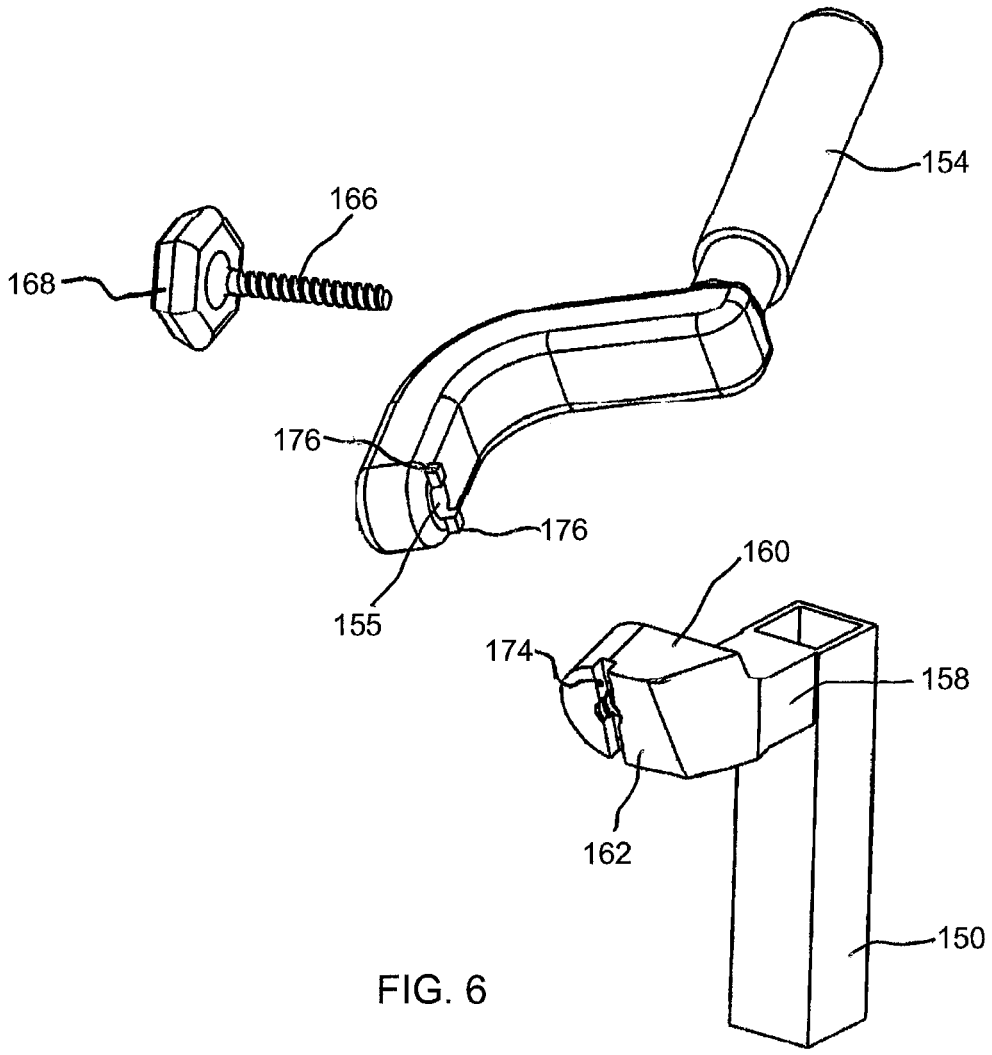
FIG. 6 is an exploded partial perspective view of an alternate configuration of a handlebar of the climbing exercise apparatus shown in FIG. 1.
Figure 7:
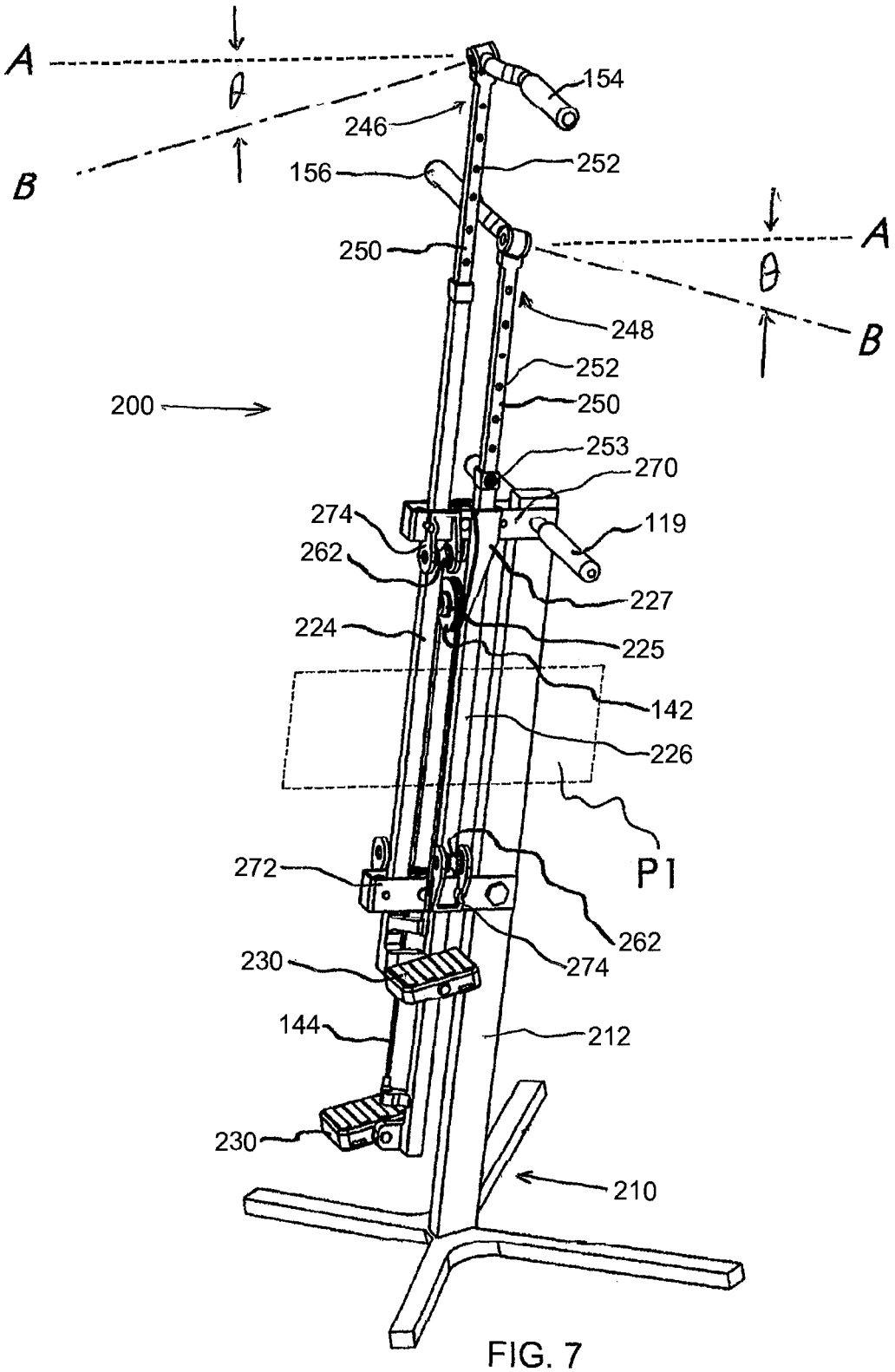
FIG. 7 is a perspective view of a second embodiment of a climbing exercise apparatus.
Figure 8:
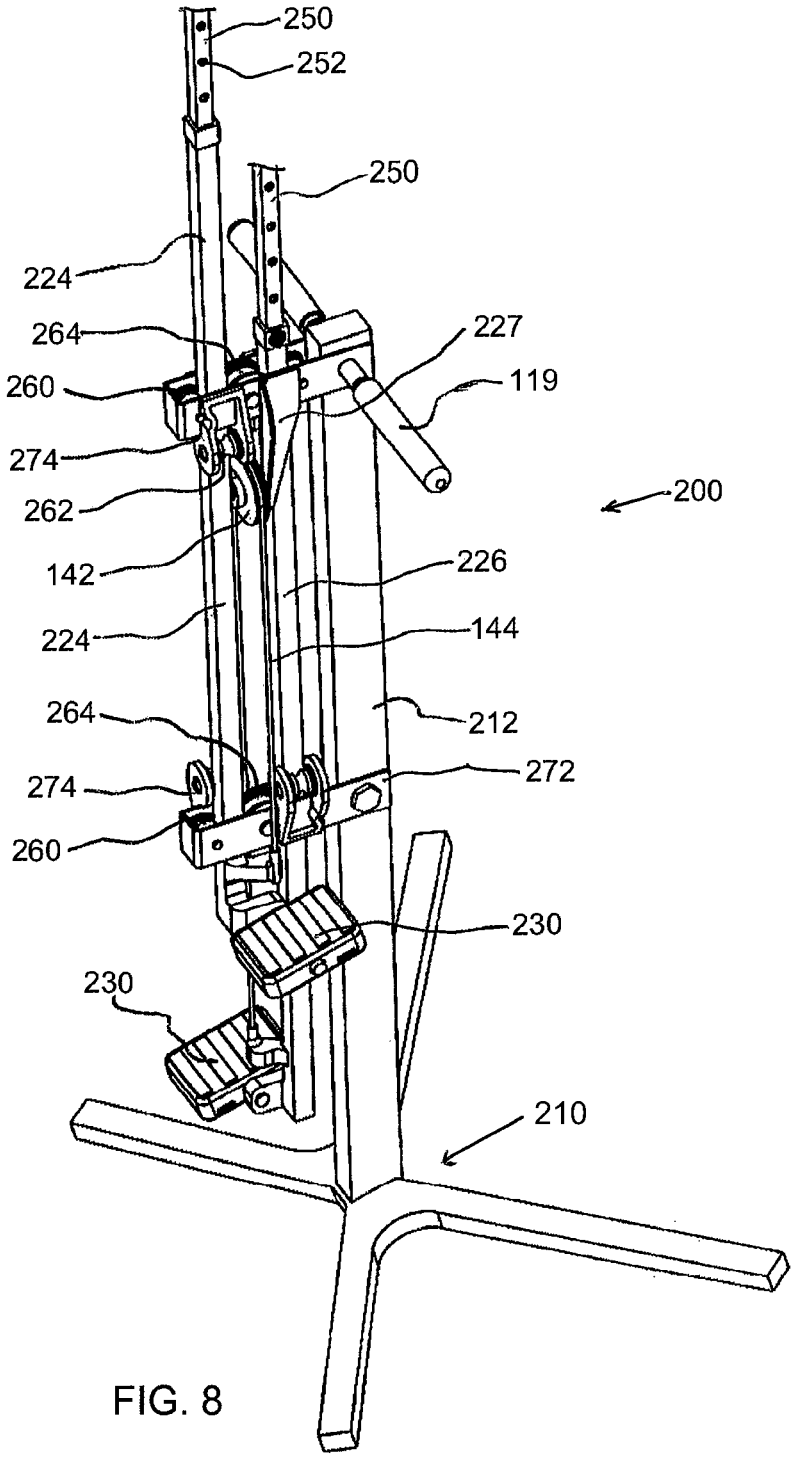
FIG. 8 is a partial perspective view of the climbing exercise apparatus shown in FIG. 7.
Figure 9:
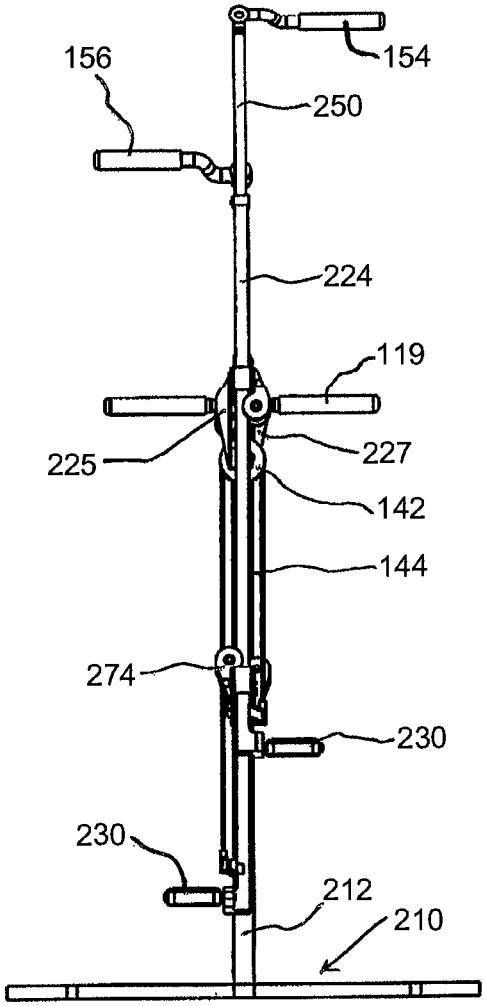
FIG. 9 is a front view of the climbing exercise apparatus shown in FIG. 7.

An alternate configuration for locking the handgrips 154, 156 to the handlebar leg members 150 is shown in FIG. 6. The face 162 of the stub boss 160 may include a generally vertical groove 174 intersecting the threaded borehole 164. The handgrips 154, 156 may include upstanding tabs 176 on opposite sides of the hole 155 at the distal ends of the handgrips 154, 156. The grooves 174 and tabs 176 may intersect the axes B at right angles. The tabs 176 may be received in respective grooves 174 and the knob 168 tightened to lock the handgrips 154, 156 to the handlebar leg members 150.

Referring now to FIG. 7-FIGS. 11A-11C, a second embodiment of a climbing exercise apparatus is generally identified by the reference numeral 200. As noted by the common use of reference numerals, the climbing exercise apparatus 200 is similar to the climbing exercise apparatus 100 with the exception that the tubular slide members 224, 226 are generally displaced front to back with respect to each other, rather than the side by side arrangement of the climbing exercise apparatus 100. Similar to the climbing exercise apparatus 100, a pulley 142 and cable 144 may cooperatively provide oppositional dependent action of the slide members 224, 226, where the cable 144 is routed over the pulley 142, and the distal ends of the cable 144 are fixedly secured to respective slide members 224, 226. Handlebars 246, 248 may adjustably telescope into or out of respective slide members 224, 226 in a selective manner. Detent adjustment holes 252 and the like arranged on the leg members 250 of the handlebars 246, 248 may be cooperatively engaged by spring biased pins 253 and the like secured to the slide members 224, 226 to position the handgrips 154, 156 to the user's expected arm reach height. Foot platforms 230 may be secured proximate the lower ends of the slide members 224, 226 generally in a non-adjustable manner, however, in some instances pivoting of the foot platforms 230 may be provided to permit orientation change of the user's foot.

Figure 10:
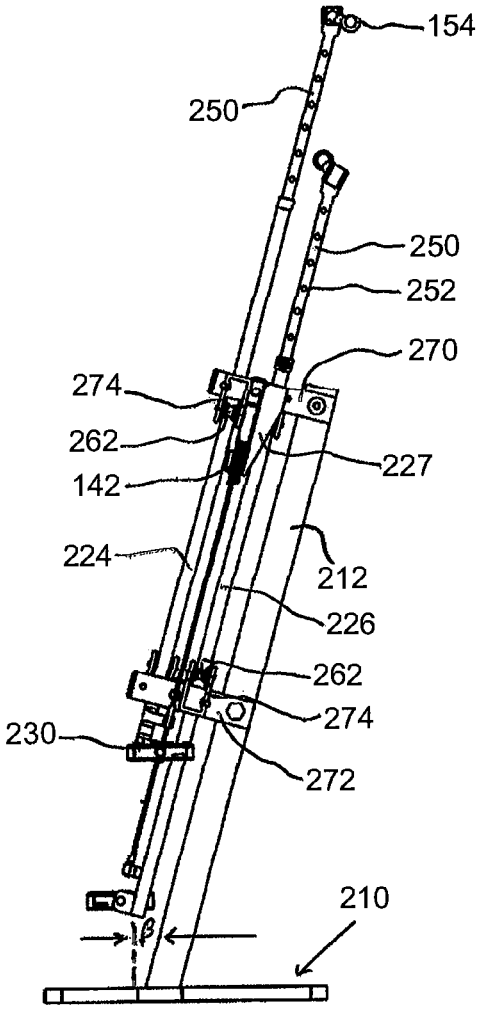
FIG. 10 is a side view of the climbing exercise apparatus shown in FIG. 7.

The climbing exercise apparatus 200 may include a frame comprising a base 210 and a stanchion 212 extending generally vertically upward from the base 210 angled generally forward at an acute angle β of about fifteen (15°) degrees, shown in FIG. 10. The slide members 224, 256 may be linearly secured to the frame 210 by rollers or unillustrated slides. The slide members 224, 226 may be secured to the frame 210 by guide members comprising two or more generally U-shaped brackets 270 and 272 which are vertically spaced from one another and are fixedly secured to the stanchion 212. For purposes of illustration, but not by way of limitation, the slide members 224, 226 may be linearly constrained by rollers 260, 262 and 264. Rollers 260 and 264 may be disposed between the sidewalls of the brackets 270, 272 and rotatably secured thereto. Front to back rolling constraint may be provided by center roller 264 disposed between slide members 224, 226 (where roller 264 is tangent with opposed moving surfaces of the slide members 224, 226) and by the rollers 260 which may be in rolling contact with the sides of the slide members 224, 226 opposite the rollers 264. Additional side to side rolling constraint may be provided by the lateral rollers 262 which are rotatably secured to roller brackets 274. The roller brackets 274 may be fixedly secured to the brackets 270, 272. The lateral rollers 262 may be oriented perpendicular to the rollers 260 and may be in rolling contact with opposite sides of the slide members 224, 226. It will be recognized by those skilled in the art that the rollers 262 may be omitted in the event the rollers 260 include circumferential flanges.

The pulley 142 may be disposed between the slide members 224, 226 below the bracket 270. The pulley 142 may be rotatably supported by support arms 225, 227 which are secured to and extend downward from opposite sides of the bracket 270. The frame 210 may include fixed handles 119 that a user may grasp to steady himself or while reciprocating only his legs in an up and down motion.

Figure 11A:
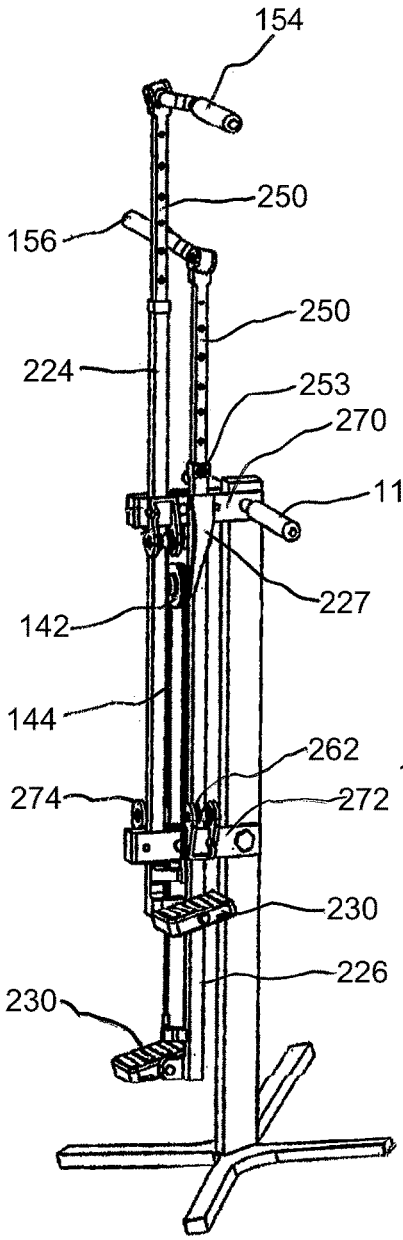
FIGS. 11A-11C are perspective views depicting the transition from the homolateral exercise mode to the contralateral exercise mode of the climbing exercise apparatus shown in FIG. 7.
Figure 11B:
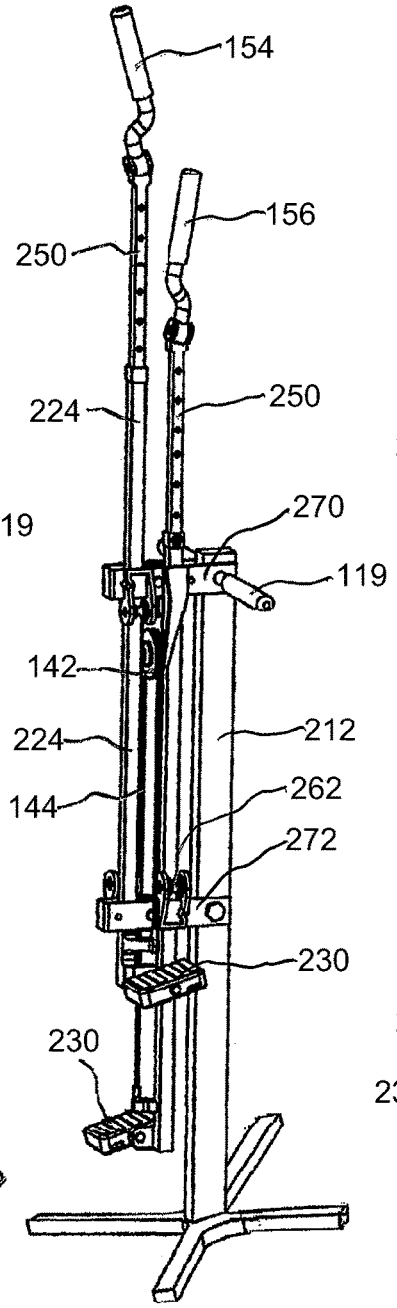
Figure 11C:
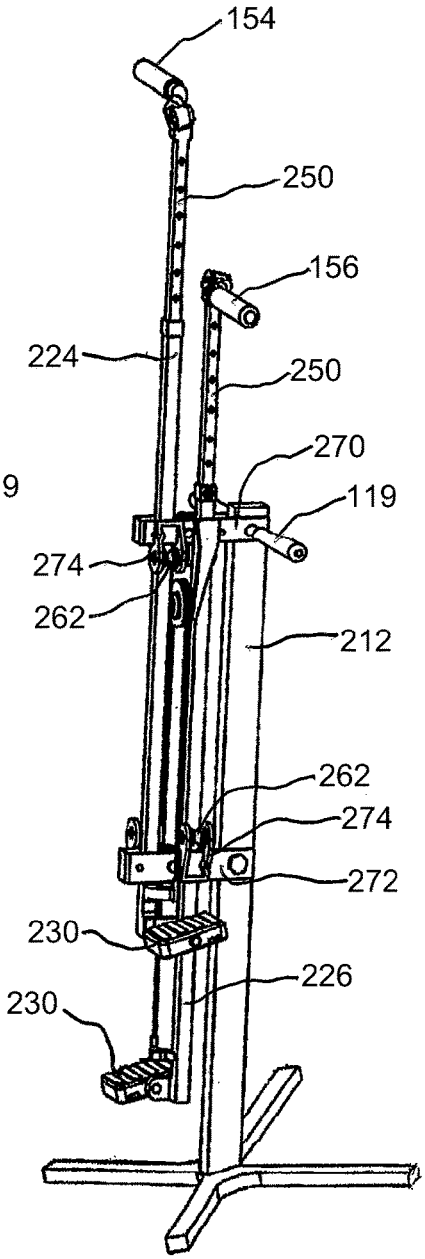

As with the climbing exercise apparatus 100, the canted axes B prevent collision of the handgrips 154, 156 upon rotation about the axes B. FIGS. 11A-11C depict the transition of the handgrips 154, 156 from the homolateral mode to the contralateral mode of operation of the climbing exercise apparatus 200. The canted angle θ, for example, but not by way of limitation, illustrated in FIG. 7, may be approximately eighteen (18°) degrees.

Figure 12:
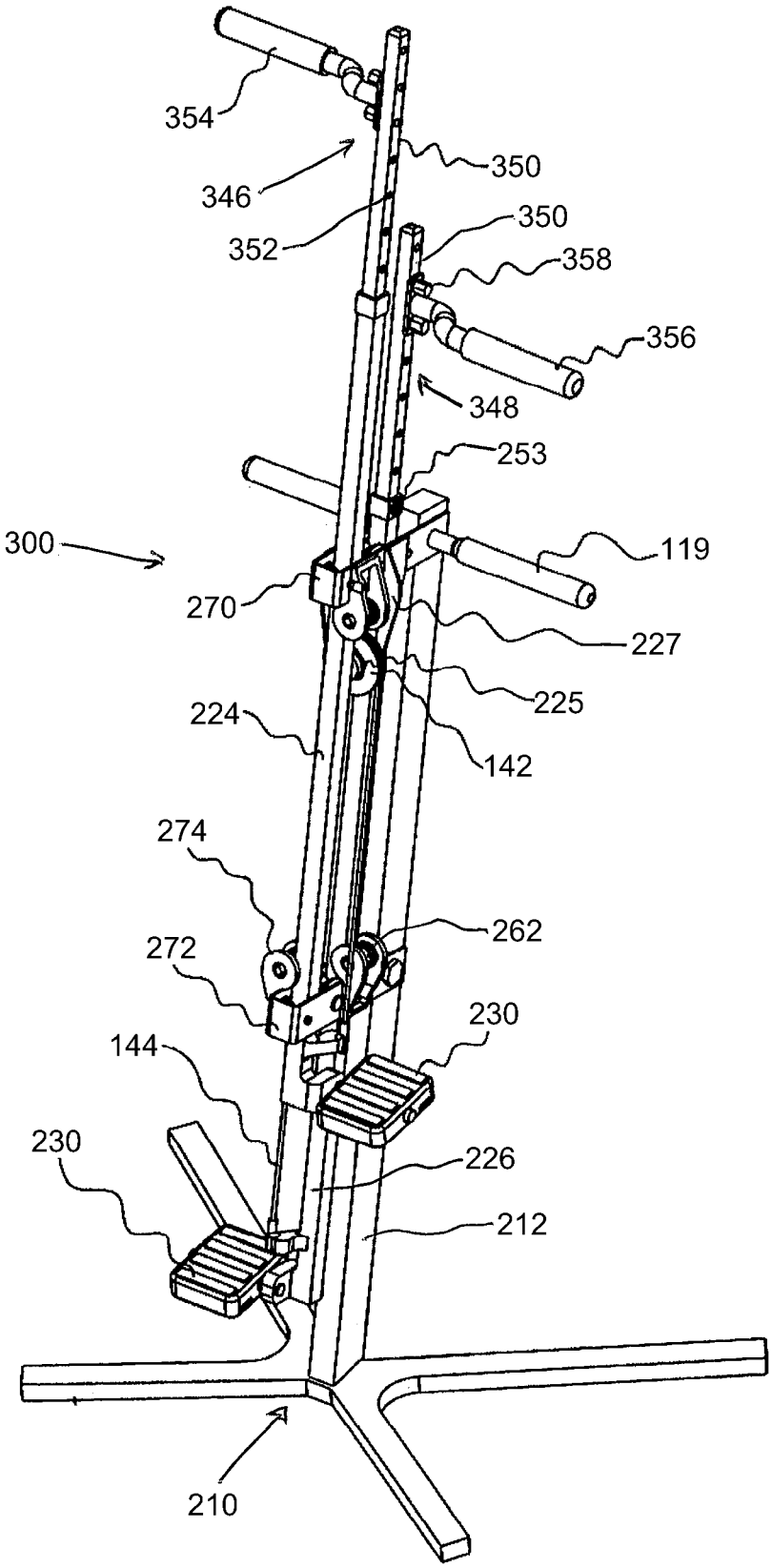
FIG. 12 is a perspective view of a third embodiment of a climbing exercise apparatus.
Figure 13:
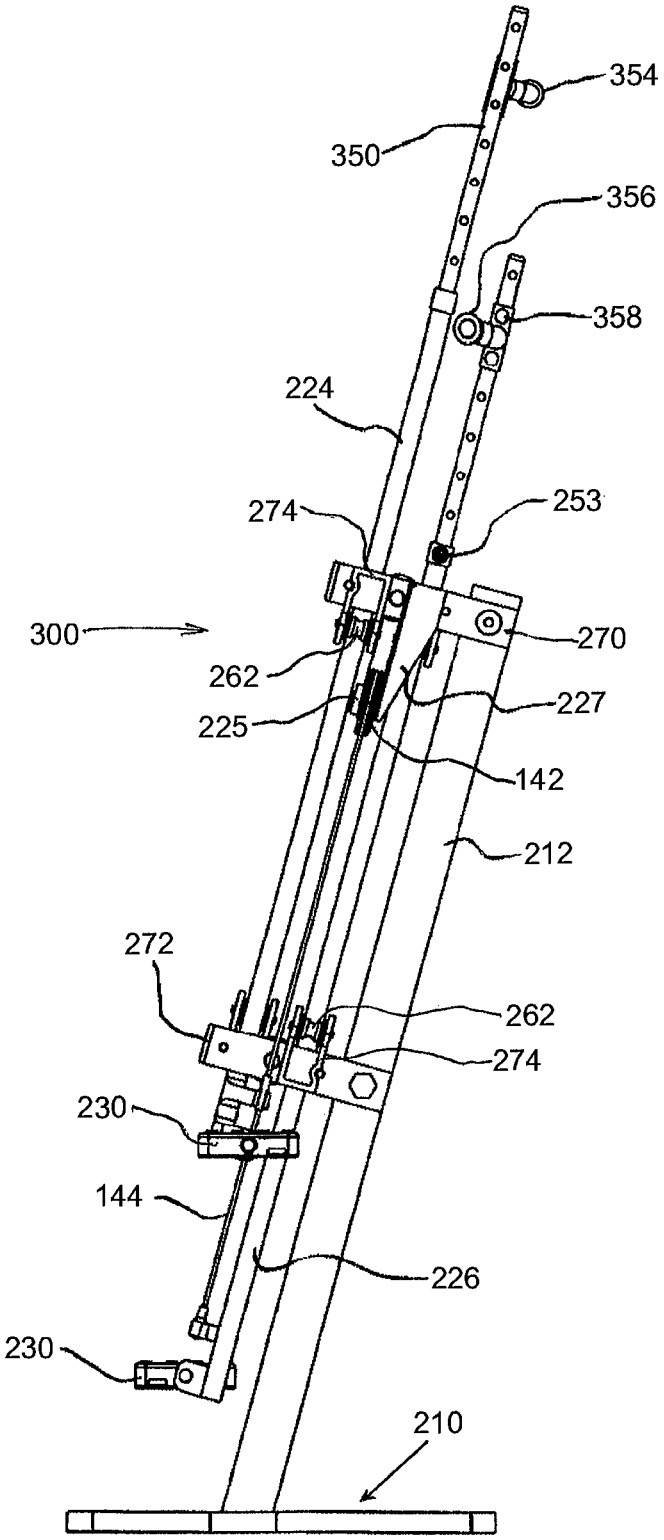
FIG. 13 is a side view of the climbing exercise apparatus shown in FIG. 12.

Referring now to FIGS. 12 and 13, a third embodiment of a climbing exercise apparatus is generally identified by the reference numeral 300. As noted by the common use of reference numerals, the climbing exercise apparatus 300 is similar to the climbing exercise apparatus 200 with the exception that the handgrips 354 and 356 are not rotatable about a canted axis. Similar to the climbing exercise apparatus 200, the tubular slide members 224, 226 are generally displaced front to back with respect to each other. A pulley 142 and cable 144 may cooperatively provide oppositional dependent action of the slide members 224, 226, where the cable 144 is routed over the pulley 142, and the distal ends of the cable 144 are fixedly secured to respective slide members 224, 226. Handlebars 346, 348 may adjustably telescope into or out of respective slide members 224, 226 in a selective manner. Detent adjustment holes 352 and the like arranged on the leg members 350 of the handlebars 346, 348 may be cooperatively engaged by spring biased pins 253 and the like secured to the slide members 224, 226 to position the handgrips 354, 356 to the user's expected arm reach height. Foot platforms 230 may be secured proximate the lower ends of the slide members 224, 226 generally in a non-adjustable manner, however, in some instances pivoting of the foot platforms 230 may be provided to permit orientation change of the user's foot.

The handgrips 354, 356 may be releasably secured to the leg members 350 of the handlebars 346, 348 for homolateral or contralateral exercise modes. For purposes of illustration, but not by way of limitation, bolts or pins 358 and the like may be utilized to secure the handgrips 354, 356 to the leg members 350. Alternatively, pins may project from the distal ends of the handgrips 346, 348 (not shown in the drawings) that may be inserted into the hole 352 to secure the handgrips 354, 356 to the leg members 350. Other means and methods may be employed to secure the handgrips 354, 356 to the leg members 350, such as frictions clamps. Geometric shapes (male or female) such as a square, rectangle or triangle may be formed on the leg members 350 and a corresponding square, rectangle or triangle formed on the handgrips 354, 356 for mating engagement therewith.

While preferred embodiments of the invention have been shown and described, other and further embodiments of the invention may be devised without departing from the basic scope thereof, and the scope thereof is determined by the claims which follow.

The invention claimed is:

1. A climbing exercise apparatus, comprising:

a) a frame having a base;

b) a left guide member and a right guide member fixedly secured to said base, said left guide member and said right guide member extending generally vertically in spaced, parallel alignment with one another;

c) a left elongated tubular member and a right elongated tubular member movably supported respectively by said left guide member and said right guide member;

d) a left handlebar and a right handlebar respectively coupled to said left elongated tubular member and said right elongated tubular member;

e) a left handgrip and a right handgrip movably and respectively secured to said left handlebar and said right handlebar, each said left handgrip and said right handgrip movable about a canted axis from a first position to a second position for performing homolateral or contralateral climbing exercises; and f) a left foot support and a right foot support secured respectively proximate to a lower distal end of said left elongated tubular member and said right elongated tubular member.

2. The climbing exercise apparatus of claim 1 wherein said left handlebar and said right handlebar each include a leg member slidably received respectively by said left elongated tubular member and said right elongated tubular member, and further including a mounting stub projecting outwardly from proximate to an upper end of said leg member defining a first axis perpendicular to a longitudinal axis of said leg member.

3. The climbing exercise apparatus of claim 2 wherein said canted axis is canted relative to said first axis.

4. The climbing exercise apparatus of claim 2 wherein said canted axis is canted at an angle between 5° and 30° relative to said first axis.

5. The climbing exercise apparatus of claim 1 including a transverse bracket connected proximate to upper distal ends of said left guide member and said right guide member, a plurality of rollers rotatably supported by said transverse bracket providing lateral constraint to said left elongated tubular member and said right elongated tubular member.

6. The climbing exercise apparatus of claim 2 wherein each said mounting stub includes a flat surface inclined rearward from a top edge to a bottom edge of said flat surface, wherein said flat surface includes circumferentially displaced tips and divots cooperatively and respectively engaging an interface surface of each said left handgrip and said right handgrip.

7. The climbing exercise apparatus of claim 5 including a left foot bracket and a right foot bracket respectively connected proximate to said lower distal ends of said left elongated tubular member and said right elongated tubular member, a plurality of foot platform rollers rotatably secured to each of said left foot bracket and said right foot bracket to linearly constrain said left elongated tubular member and said right elongated tubular member, respectively.

8. A climbing exercise apparatus, comprising:

a) a frame;

b) a pair of guide members fixedly secured to said frame and extending generally vertically in spaced, parallel alignment with one another;

c) a pair of tubular members movably and respectively supported by said pair of guide members;

d) a pair of handlebars respectively coupled to said pair of tubular members;

e) a pair of handgrips movably and respectively secured to said pair of handlebars, each said handgrip movable about a canted axis; and f) a pair of foot supports respectively secured proximate to a lower distal end of each of said pair of tubular members.

* * * * *